US006100779A

United States Patent [19]

Luard et al.

[11] Patent Number: 6,100,779

[45] Date of Patent: Aug. 8, 2000

[54] CRT DEFLECTION UNIT AND ITS METHOD OF MANUFACTURE

[75] Inventors: Stephen P. A. Luard, Broom Park; Robert Carr, Pelton, both of United Kingdom

[73] Assignee: U.S. Philips Corporation, New York, N.Y.

[21] Appl. No.: 09/198,926

[22] Filed: Nov. 24, 1998

Related U.S. Application Data

[62] Division of application No. 08/708,155, Aug. 27, 1996, abandoned.

[30] Foreign Application Priority Data

Aug. 31, 1995 [GB] United Kingdom ..... 9517763

[51] Int. Cl.[7] ..... H01F 7/00

[52] U.S. Cl. ..... 335/210; 335/213; 313/440; 348/829; 348/830

[58] Field of Search ..... 335/210–214; 313/440; 348/828–831

[56] References Cited

U.S. PATENT DOCUMENTS

| | | | |
|---|---|---|---|
| 3,810,053 | 5/1974 | McGlashan | 335/212 |
| 3,878,490 | 4/1975 | Logan | 335/210 |
| 4,673,906 | 6/1987 | Petrow | 335/210 |
| 4,687,966 | 8/1987 | Carroll et al. | 313/440 |
| 4,749,975 | 6/1988 | Tokita et al. | 335/217 |
| 5,138,290 | 8/1992 | Togane et al. | 335/210 |
| 5,404,204 | 4/1995 | Swinkels | 335/211 |

FOREIGN PATENT DOCUMENTS

| | | | |
|---|---|---|---|
| 3017367A1 | 11/1981 | Germany | H01J 9/236 |

*Primary Examiner*—Michael L. Gellner
*Assistant Examiner*—Raymond Barrera
*Attorney, Agent, or Firm*—Robert J. Kraus

[57] ABSTRACT

The deflection unit has a yoke ring mounted on, and secured to, a coil assembly comprising deflection coils carried on a support. The yoke ring (22) is secured using a flow process in which the coil assembly is rotated about a vertical axis and flowable adhesive, e.g. polyurethane resin, is directed at one end (28) of the yoke ring such that the adhesive (30) flows over its outer surface (24) to its other end, forming a protective coating, and onto an adjacent part (20) of the coil assembly. The adhesive flows also over a substantial portion of the inner surface (23) of the yoke ring in the gap between the yoke ring and the coil assembly providing extensive bonding (32) between the yoke ring and the coil assembly which reduces unwanted noise effects from the unit in subsequent operation.

10 Claims, 2 Drawing Sheets

CRT DEFLECTION UNIT AND ITS METHOD OF MANUFACTURE

CROSS REFERENCE TO RELATED APPLICATIONS

This is a divisional of application Ser. No. 08/708,155, filed Aug. 27, 1996, now abandoned.

BACKGROUND OF THE INVENTION

The present invention relates to a deflection unit for a CRT having a yoke ring mounted on and secured by means of adhesive to a deflection coil assembly comprising a support carrying a set of deflection coils. The invention relates also to a method of manufacturing a deflection unit for a CRT which method comprises the steps of mounting a yoke ring on a deflection coil assembly and securing the yoke ring to the deflection coil assembly by means of adhesive.

There is disclosed in EP-A-0 534 531 a deflection coil assembly and a method for its manufacture in which a preformed and shaped set of deflection coils, for example, a set of vertical, or field, deflection coils of the saddle-type, is secured on the outer surface of a hollow coil support of synthetic material by means of an ultrasonic welding technique through which portions of the support are softened by localised heating and urged towards the deflection coils such that the coils of the support become joined, and fixed, together. A set of horizontal, or line, deflection coils is secured to the inner surface of coil support in similar manner. After forming the coil assembly in this way, the yoke ring, which is flared and conforms generally to the outer surface shape of the assembly, is positioned over the outer surface of the assembly, with the wider, base, end of the flared yoke ring resting against a radially extending part of the coil assembly, and secured in position.

In a known method of securing the yoke ring to a coil assembly, a ring of epoxy resin is applied around the smaller diameter, neck, end of the yoke ring which bridges the gap locally between the radially-extending end face of the yoke ring and the coil assembly and secures the yoke ring to the assembly at that end while the wider end of the yoke ring is bonded to the radially extending part of the assembly, comprising a radial surface of the support supporting portions of the field coils, by applying separately a polyurethane resin at spaced locations around the periphery of the outer surface of the yoke ring at its base end which runs, through gravity, onto the radial part of the assembly to connect and bond the base end of the yoke ring to the assembly. In this way, the yoke ring is secured to the deflection coil assembly at both ends. Application of the epoxy and polyurethane resins to the neck and base of the yoke ring is automated. The epoxy resin and polyurethane resins are supplied from separate dispenser nozzles, the epoxy resin being applied to neck of the yoke ring while effecting relative displacement between the coil assembly, carrying the yoke ring, and the dispenser nozzle and the polyurethane resin being applied in a static process in which predetermined quantities of the resin are dispensed through separate outlets positioned around the yoke ring towards its base.

SUMMARY OF THE INVENTION

It is an object of the present invention to provide an improved method of manufacturing a deflection unit.

It is another object of the present invention to provide an improved deflection unit.

According to one aspect of the present invention, there is provided a method of manufacturing a deflection coil unit as described in the opening paragraph which is characterised in that the step of securing the yoke ring on the deflection coil assembly comprises rotating the deflection coil assembly together with the yoke ring and directing flowable adhesive onto the yoke ring at one end thereof such that the adhesive flows over the outer surface of the yoke ring from said one end to the region of the deflection coil assembly adjacent the other end thereof. Thus, bonding of the yoke ring to the deflection coil assembly at both ends, i.e the neck and base, is achieved by using one application of adhesive and the need for separate applications of different adhesives as in the known method, requiring two different dispensers, is avoided. Consequently, the method of the invention results in the simplification of the adhesive-applying components in the production equipment. The rotation of the yoke ring and deflection coil assembly and the flow of the applied adhesive resulting therefrom ensure a general evenness and uniformity of the coating of adhesive obtained around the outer surface of the yoke ring and, importantly, a high integrity bond between the yoke ring and coil assembly around the periphery of each end of the yoke ring where the adhesive flows over and around coil parts at those regions and parts of the surface of the coil support at those regions. Moreover, the coating of adhesive produced over the outer surface of the yoke ring, which preferably extends substantially continuously and completely over the yoke ring's outer surface, forms a protective layer that serves to protect the yoke ring from possible damage before the deflection unit is finally assembled on a CRT. Also, should any small cracks be present in the outer surface of the yoke ring, which cracks may go unnoticed from visual inspection, this coating has a bonding effect and serves to prevent such cracks opening subsequently which may otherwise occur during use of the unit on a CRT.

Preferably, the adhesive is applied to the end of the yoke ring such that it flows also over a substantial portion of the inner surface of the yoke ring from that end. The coating of a substantial portion of the inner surface of the yoke ring in this way leads to a more extensive bonding between the yoke ring and the deflection coil assembly, particularly over the region of the yoke ring adjacent the end where the adhesive is directed, preferably the neck end, compared with that obtained in the known method. Flow of the adhesive upon rotation of the deflection coil assembly causes it to spread over the inner surface of the yoke ring and in gaps between the inner surface of the yoke ring and the deflection coil assembly. Adhesive which flows to the other end of the yoke ring may also continue to flow around that end and over and around the adjacent part of the coil assembly and inwardly along the inner surface of the yoke ring from that end.

The adhesive is preferably applied to the neck end of the yoke ring, although it is envisaged that the adhesive could perhaps be applied instead to the base end.

The method is highly reproducible and reliable, as well as being comparatively simple to perform, thus making it ideally suited to mass production. The adhesive may be any suitable adhesive which is capable of flowing in the required manner when applied and before it sets or hardens. Preferably, the adhesive comprises a quick cure polyurethane resin. Such a resin is particularly attractive as it can be formulated to meet the required specification as regards flow and bonding strength characteristics.

The flow of the adhesive, particularly over the inner surface of the yoke ring, results in a further significant advantage in the finished deflection unit. The coating of adhesive over a substantial portion of the inner surface of the yoke ring has the effect of reducing considerably the amount of noise created in the deflection unit in operation in a CRT. This reduction is due primarily to the increased area of bonding between the yoke ring and the coil assembly produced thereby compared with that obtained with the known method using a band of epoxy resin. Noise is produced by the field (frame) coil of the coil assembly when being driven and the surrounding yoke ring tends to amplify this noise. It is believed that the reduction in noise results from the extended bonding of the inner surface of the yoke ring to the coil assembly dampening unwanted vibrations and a consequential change to the effective node length of the field coil, and its resonant frequency. The coating on the outer surface of the yoke ring may possibly also serve to reduce noise to some extent due to its effect in altering the resonant frequency of the yoke ring.

According to another aspect of the present invention, therefore, there is provided a deflection coil unit for a CRT comprising a yoke ring mounted over a deflection coil assembly and secured to the deflection coil assembly by adhesive, which is characterised in that the adhesive extends from one end of the yoke ring over a substantial part of the area between the inner surface of the yoke ring and the portion of the coil assembly adjacent thereto. Preferably, the adhesive also extends from said one end as a coating over a substantial portion of the outer surface of the yoke ring between its ends. The adhesive may extend from the one end of the yoke ring over its outer surface to the other end and onto a part of the coil assembly adjacent that other end. The outer surface of the yoke ring may be completely covered by such a coating.

As mentioned, the provision of such coating(s), particularly over the inner surface of the yoke ring, substantially reduces the amount of noise from the deflection coil unit in subsequent operation in a CRT.

BRIEF DESCRIPTION OF THE DRAWING

An embodiment of a deflection unit and its method of manufacture, in accordance with the present invention, will now be described, by way of example, with reference to the accompanying drawing figures in which.

It should be understood that the Figures are merely schematic and have not been drawn to scale. The same reference numbers are used throughout the Figures to designate the same or similar parts.

DESCRIPTION OF THE PREFERRED EMBODIMENTS

Figure 1:
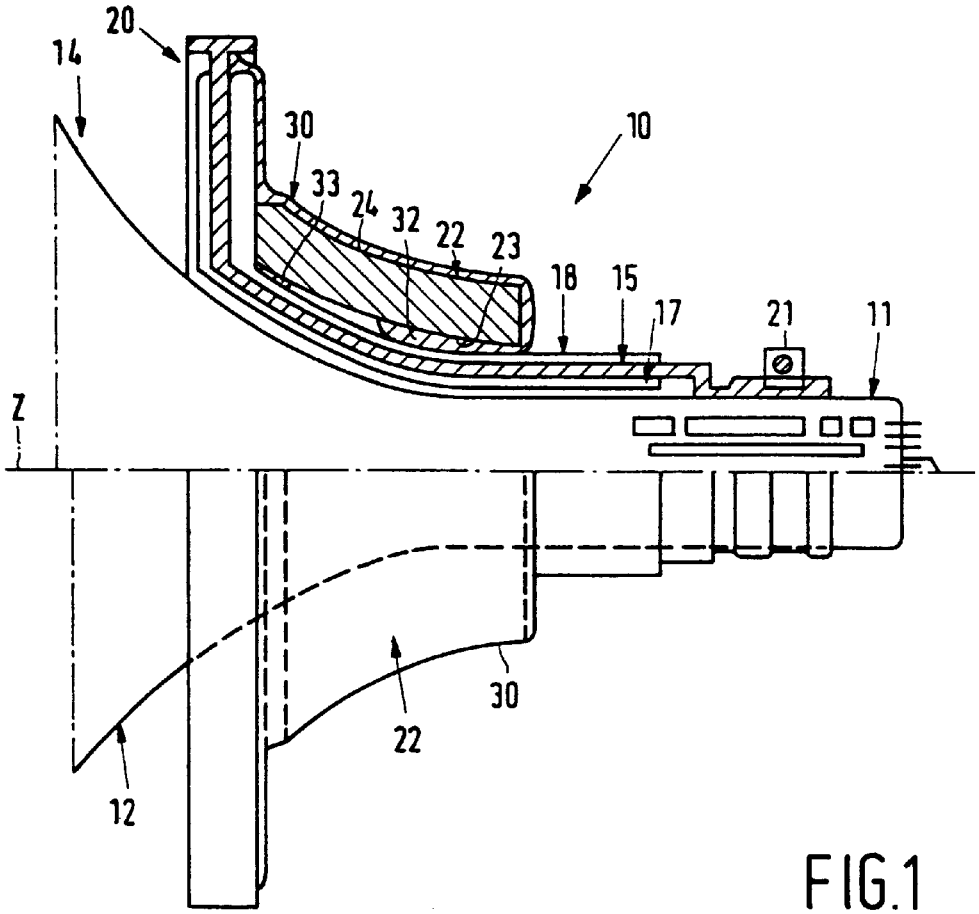
FIG. 1 shows schematically, partly in cross-section and partly in side elevation, a part of a CRT with an embodiment of a deflection coil unit according to the present invention mounted thereon.
Figure 2:
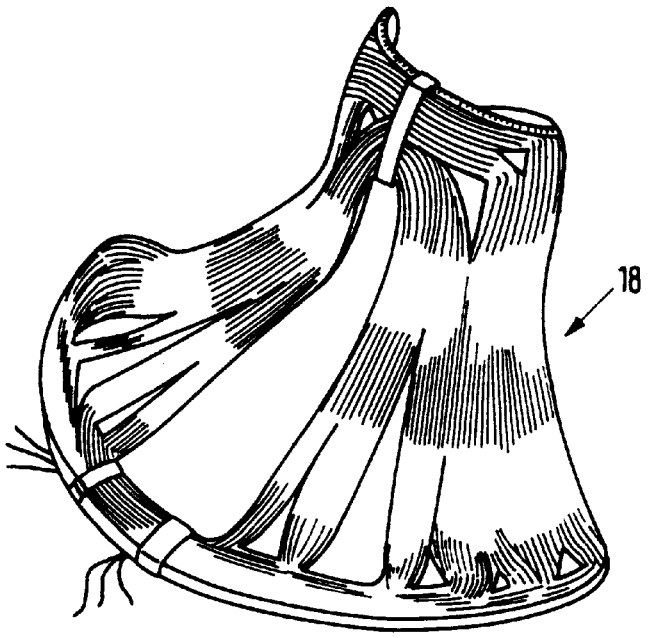
FIGS. 2 and 3 are perspective views of a field deflection coil and a line deflection coil respectively of the deflection coil unit.
Figure 3:
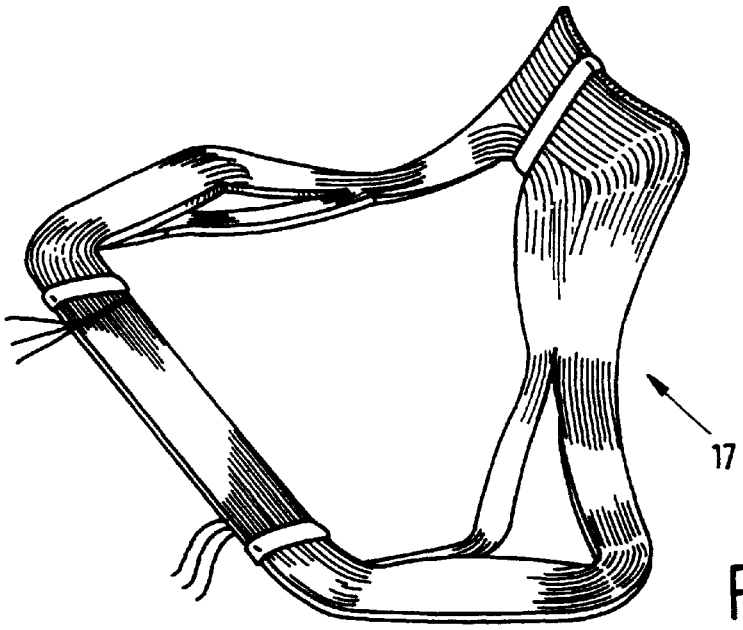

Referring to FIG. 1, the deflection unit, indicated generally at 10, is shown mounted on the glass envelope of a CRT 14 at the region between a neck 11 and cone portion 12 of the envelope. The deflection unit 10 comprises a coil support 15 of synthetic material and of generally frusto-conical shape which carries on its inner side, adjacent the envelope surface, a set of two line (horizontal) saddle-type deflection coils 17, one of which is shown in FIG. 3, and on its outer side a set of two field (vertical) deflection coils 18, one of which is illustrated in FIG. 2. The coil support 15 has at its one, front, end, a generally circular, radially-extending part 20 defining front and rear surfaces extending orthogonally to the central axis Z of the envelope 14 and the deflection unit 10 which support end portions of the line and field deflection coils 6 and 7 respectively. The coil support 15 together with the sets of deflection coils 17 and 18 secured thereto form a deflection coil assembly. A hollow yoke ring 22, in the shape of a flared annulus conforming generally with the outer contour of the coil assembly is mounted over the outside of the assembly and fixed thereto. The yoke ring 22 is a unitary sintered moulding of soft magnetic material, manufactured, for example, according to the method described in U.S. Pat. No. 4,564,489, having continuous inner and outer surfaces 23 and 24 between its front and rear ends, and surrounds the coil assembly with its front, base, face disposed against an inner portion of the radially-extending part of the coil assembly while its rear, neck, end terminates over an intermediate part of the coil assembly. The front end of the deflection unit 10 is supported by the cone portion 12 with its position fixed, after being slid over the neck portion 11, by means of adjustable fixing elements (not shown). The rear end of the coil support 15 is clamped around the neck 11 of the envelope by means of a strap 21.

Figure 4:
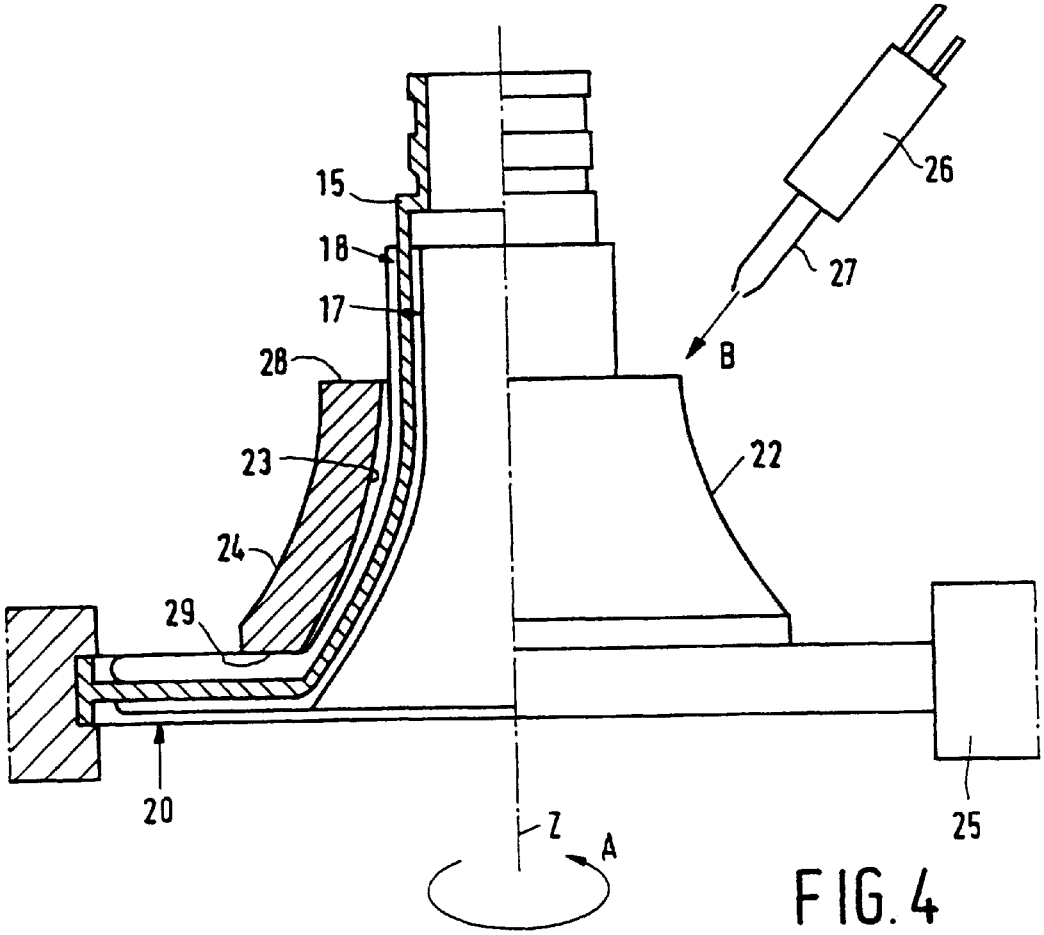
FIG. 4 illustrates a stage in the manufacture of the deflection coil unit in which the yoke ring is mounted over, and bonded to, the deflection coil assembly.

The manufacture of the deflection coil unit, and more particularly the step of securing the yoke ring 22 on the deflection coil assembly will now be described with reference to FIG. 4. The deflection coil assembly is produced by mounting and fixing on the coil support 15 pre-formed and shaped sets of deflection coils 17 and 18. To this end, the deflection coils 17 and 18 may, for example, be bonded to the synthetic material coil support 15 by means of a heat treatment process in which the support and deflection coils are urged together and localised regions of the support are softened by heating so that the support is pressed into the coils at those regions, as described in EP-A-0 534 531 to which reference is invited for further information and whose disclosure is incorporated herein by reference.

This deflection coil assembly is mounted in a jig with its central axis Z extending vertically and the yoke ring 22 placed over the assembly with its front end face resting directly on the end portions of the set of deflection coils 18 extending over the rear surface of the radial port 20 of the coil support 15 and with its inner surface 23 resting directly against surface parts of the set of deflection coils 18 at spaced locations, according to the shape of the particular coils 18 used. The position of the yoke ring is adjusted for symmetry of magnetic field with its axis aligned with the axis Z, following which the yoke ring is temporarily fixed to the coil assembly by spots of cyanoacrylate adhesive. FIG. 4 illustrates the deflection unit at this stage of manufacture with the jig holding the coil assembly, at the radial part 20 of the coil support 15, being indicated at 25. A spigot (not shown) may be positioned inside the coil assembly to maintain concentricity during rotation.

The coil assembly is then rotated around its vertical, central, axis Z, carrying with it the yoke ring 22, as indicated by the arrow A to a speed of around 30 rpm. While the yoke ring and coil assembly are being rotated, a predetermined quantity of quick cure polyurethane resin from a static mixing head direct action pump 26 is directed by a nozzle 27 onto the yoke ring at the region of its open neck end face 28, as indicated by the arrow B, at a selected angle and distance so as to achieve a flow of the deposited resin over the neck end and the inner and outer surfaces 23 and 24 of the yoke ring 22. A head of resin is produced over the gap between the neck end face 28 and the coil assembly, producing a continuous bridge between them, the resulting pressure forcing the resin inwardly down the gap. The resin application parameters may be varied according to the particular deflection unit being produced and, for example, the size and shape of its yoke ring. Typically, approximately 90 gm of resin may be applied over eight seconds or so. Due to rotational and gravitational effects, the resin flows from the face 28 over the outer surface 24 of the yoke ring 22 to its base end to cover completely that surface with a coating of the resin, and also from the base end of the yoke ring onto and around the adjacent end portions of the sets of coils 18 and intervening surface regions of the coil support 15 at its radial part 20 and into the regions between the base end face 29 and the coil assembly around those parts of the coils which are in direct contact with the end face. The resin caused to flow into the gap between the inner surface 23 of the yoke ring and the deflection coil assembly spreads part way along the length of the yoke ring to coat a substantial portion of the inner surface 23 and around adjacent parts of the coil assembly, i.e. parts of the deflection coils which are touching or close to that inner surface portion and surface regions of the coil support through windows in the field coil 18. The resin may be caused to flow, by suitable choice of application parameters such as rotation speed, the quantity and dispensing rate of the resin and the direction of deposition, to approximately mid-way over the length of the inner surface 23. By virtue of the rotation of the assembly and the flowing nature of the resin the coating of resin obtained particularly on the outer surface of the yoke ring is of substantially uniform thickness at given distances along its length, and a general evenness of resin distribution around the periphery of the interior and exterior parts of the yoke ring is achieved. At a region toward the neck end face 28 of the yoke ring a continuous resin bridge between the yoke ring and the coil assembly is obtained. The resin is caused to spread around the parts of the coil assembly in contact with the yoke ring and into spaces between those parts and bounded by the yoke ring inner surface 23 and the surface of the coil support 16. In typical trials using a yoke ring 50 mm in length, it has been found that the resin penetrates the gap to coat the inner surface 23 of the yoke ring over approximately 20 mm of its length, with a continuous bridge of resin being formed between, and filling, that surface and the coil assembly beginning approximately 6 to 8 mm from the end of the yoke ring over a length of around 8 to 15 mm. Some resin also flows around the base end face 29 of the yoke ring and climbs up the inner surface 23 of the yoke ring into gaps between the inner surface 23 adjacent the base end and the coil assembly at that region. The rotational speed of the assembly during resin deposition may be varied. As centrifugal forces play a part in the distribution of the resin, their effect in achieving the required flow will be a factor in selecting rotational speed.

After this resin flow process has been carried out, rotation is stopped and the resin is allowed to cure, which usually takes a few minutes. When cured, the resin extending between the base of the yoke ring 22 and the radial part of the coil assembly serves to bond the yoke ring securely to the assembly around that end. Resin on the inner surface 23 of the yoke ring and around parts of the coil assembly close to that inner surface serves to bond securely the yoke ring to the coil assembly at those regions. Because the resin extends a substantial distance from the neck of the yoke ring between the inner surface 23 and the coil assembly along a significant part of the length of the yoke ring, such bonding occurs over a substantial area and at a number of locations, which will be dependent on the particular shape of the set of deflection coils 18.

Referring again to FIG. 1, the coating of resin obtained from this method of yoke ring fixation is shown schematically at 30. This coating extends as a single, continuous, layer from close to the periphery of the part 20 generally continuously over the outer surface 24 and the neck end face of the yoke ring 22 and approximately half way along the length of the inner surface 23, as shown at 32, and over the base end face and a part of the inner surface 23 adjoining that end, as shown at 33.

As well as enabling fixation of the yoke ring at both ends to the coil assembly using a single source and application of resin and producing a bonding between the yoke ring and coil assembly of high integrity, the process results in a further benefit in that the coating of resin produced over the outer surface 24 of the yoke ring serves both to protect the yoke ring from possible damage before the deflection unit is finally assembled on the CRT envelope and to prevent any small cracks which may be present in the outer surface of the yoke ring from opening up in subsequent use of the unit in a CRT.

In operation of a CRT using the deflection unit, the amount of noise produced in the deflection unit is significantly reduced. The resin coating 32 extending over the inner surface 23 of the yoke ring in particular serves to prevent noise due to vibrations in the coils 18 caused in operation when the unit warms up. Noise typically results in operation from the flyback voltage which causes a noise peak in synchronism with the field coil frequency (e.g. 50 or 100 Hz) generally in the frequency bands 1 to 2 kHz, and 4 to 10 kHz at around 20 dB. Such noise can be amplified by the surrounding yoke ring. It is believed that the resin bridge fixing the frame coil 18 to the yoke ring 22 in effect chokes the coil frequency length and dampens vibrations. The node length of the field coil is altered with a consequential effect on its resonant frequency, thereby attenuating unwanted audible noise. The resin coating on the outer surface 24 can also be beneficial in this respect as it serves to alter the resonant frequency of the yoke ring.

Although in the above described embodiment, quick cure polyurethane resin is used, other suitable adhesives which are capable of flowing in a similar manner before they set or harden to provide secure fixation between the yoke ring and the coil assembly can be used.

The nozzle 27 need not be of the static type but may be moved around the periphery of the yoke ring while the resin is being dispensed, either in the same direction as rotation of the yoke ring/coil assembly or in the opposite direction, which may assist in obtaining the desired relationship between deposition rate and flow for coating the yoke ring.

Also it should be appreciated that the extent of penetration of the resin along the inner surface 23 of the yoke ring may differ from that in the above-described example. It may be arranged that the coating on the inner surface 23 extends further than approximately mid-way along the length of the yoke ring, and possibly completely along the length, or less than mid-way, for example around one third or one quarter of the length. The minimum preferred distance would depend on the particular shape of the deflection coil 18 around the neck region of the yoke ring as this will have an effect in determining the extent of beneficial bonding between the yoke ring and the coil assembly around that end and also the effectiveness of the coating in reducing noise.

The deflection coils may be mounted on the coil support 15 using known techniques other than that described.

From reading the present disclosure, other modifications will be apparent to persons skilled in the art. Such modifications may involve other features which are already known in the field of CRT deflection units and which may be used instead of or in addition to features already described herein.

What is claimed is:

1. A deflection unit for a CRT having a deflection coil assembly comprising a support carrying a set of deflection coils, and a yoke ring having a neck end and a base end and which is mounted over and secured by means of an adhesive to the deflection coil assembly, wherein the adhesive extends over both the neck end and the base end of the yoke ring and from at least one of said ends into a region between an inner surface of the yoke ring and adjacent surfaces of the coil assembly and provides extended bonding between the deflection coil assembly and the inner surface of the yoke ring at said adjacent surfaces, said adhesive extending from said neck end and over the outer surface of the yoke ring to said base end as a coating completely covering said outer surface.

2. A deflection unit as in claim 1 wherein the adhesive extends between a surface of the base end of the yoke ring and adjacent surfaces of the coil assembly and bonds the yoke ring to the coil assembly at said adjacent surfaces.

3. A deflection unit as in claim 1, wherein the yoke ring rests directly on deflection coils of the deflection coil assembly.

4. A deflection unit as in claim 3, wherein the yoke ring is fixed and supported on the deflection coil assembly solely by means of the adhesive.

5. A deflection unit as in claim 1, wherein the yoke ring is fixed and supported on the deflection coil assembly solely by means of the adhesive.

6. A deflection unit as in claim 1, wherein the adhesive comprises a polyurethane resin.

7. A deflection unit as in claim 1, wherein the adhesive coating covering the outer surface of the yoke ring is of uniform thickness.

8. A deflection unit as in claim 1, wherein the adhesive extends from the neck end between an area of the inner surface of the yoke ring and adjacent surfaces of the coil assembly.

9. A deflection unit as in claim 1, wherein the of adhesive includes spots of adhesive provided for temporarily holding the yoke ring in position during assembly of the deflection unit.

10. A deflection unit for a CRT having a deflection coil assembly comprising a support carrying a set of deflection coils, and a yoke ring having a neck end and a base end which is mounted over, and secured by adhesive to, the deflection coil assembly, wherein the yoke ring is bonded by an adhesive to the deflection coil assembly at both the neck end and the base end and wherein the adhesive extends over the outer surface of the yoke ring between the neck end and the base in the form of a coating which completely covers that outer surface.

* * * * *